US010981698B2

(12) United States Patent
Elstone, Sr.

(10) Patent No.: US 10,981,698 B2
(45) Date of Patent: Apr. 20, 2021

(54) PORTABLE, DEPLOYABLE CONTAINER SYSTEM

(71) Applicant: Paul J. Elstone, Sr., Medford, NJ (US)

(72) Inventor: Paul J. Elstone, Sr., Medford, NJ (US)

( * ) Notice: Subject to any disclaimer, the term of this patent is extended or adjusted under 35 U.S.C. 154(b) by 282 days.

(21) Appl. No.: 16/287,276

(22) Filed: Feb. 27, 2019

(65) Prior Publication Data

US 2020/0270021 A1 Aug. 27, 2020

(51) Int. Cl.
*B65D 21/08* (2006.01)
*B65D 43/02* (2006.01)

(52) U.S. Cl.
CPC ..... *B65D 21/086* (2013.01); *B65D 43/0202* (2013.01); *B65D 2543/00194* (2013.01)

(58) Field of Classification Search
CPC ..... B65D 43/0216; B65D 43/0222; B65D 2543/00472; B65D 21/086; B65D 21/08; B65D 43/0202; B65D 2543/00194; B65D 7/30; B65D 7/24; B65D 9/12; B65D 9/22; B65D 11/18; B65D 11/1866; B65D 11/1873; B65D 19/16; B65D 19/12
See application file for complete search history.

(56) References Cited

U.S. PATENT DOCUMENTS 3,266,656 A * 8/1966 Kridle ..... B65D 19/12 220/4.28
3,540,613 A * 11/1970 Hudson, Jr. ..... B65D 11/1873 217/12 R
3,809,278 A * 5/1974 Csumrik ..... B65D 7/30 220/4.33
5,947,312 A 9/1999 Elstone
6,032,815 A 3/2000 Elstone
6,182,849 B1 2/2001 Elstone
6,902,061 B1 6/2005 Elstone

* cited by examiner

*Primary Examiner* — Don M Anderson
(74) *Attorney, Agent, or Firm* — Archer & Greiner P.C.; Richard P. Gilly, Esq.

(57) ABSTRACT

A portable deployable container system has structural elements, including a base, a cover, and a set of panels, which can be manipulated into at least two container configurations. In one configuration, a container is formed by releasably securing the cover to the base to define a first volume. Some or all of the panels may be enclosed within such first volume, defining an undeployed configuration for the system. A second configuration involves removably securing some or all of the set of panels to the base and enclosing the panels with the cover, thereby deploying the system and forming a second, deployed configuration enclosing a volume larger than the first volume. Interconnections between the structural elements benefit from duckbill connections which add strength to the configurations by receiving flanges of first elements into corresponding channels of second elements formed by flared walls on such structural elements.

18 Claims, 7 Drawing Sheets

PORTABLE, DEPLOYABLE CONTAINER SYSTEM

FIELD

This disclosure relates to containers for transport and, in particular, to container systems which can assume at least two configurations.

BACKGROUND

Various materiel, components, instruments, machinery, weaponry, manufactured articles, and other objects often require special packaging when being shipped or otherwise transported. Items to be transported may assume any number of shapes and sizes; they may be relatively small and thereby difficult to transport efficiently without accommodating packaging; or items may be delicate, valuable, or otherwise fragile and thus risk damage during the travails of shipping or transport—whether in containers, packaging or being shipped unprotected.

The risks to items being transported may be increased when such items are transported as freight, whether in ground vehicles, trains, planes, or ships. Transportation and the vehicles associated therewith generally involve a certain amount of jostling or other undesirable forces exerted on the containers for such items or on the items themselves.

It may be important in certain applications for the contents of such containers to be efficiently and readily accessible to skilled laborers, to hoists, and to other equipment associated with loading or unloading the item, relocating the container associated with the item, or removing the item from the packaging itself As such, sturdy packaging and containers of the present art may suffer from various drawbacks and disadvantages and may be otherwise unsuitable for the transportation of certain objects and materiel. For example, certain containers and container systems may take up excessive space, even when empty, and thereby cause inefficiencies in return transportation, especially when space is at a premium, such as in aircraft or other confined cargo carrying vehicles and vessels. Weight, likewise, may be undesirably high when the container is empty, especially if the container has been manufactured to be particularly sturdy to protect fragile materiel therein. Loading or unloading associated with containers may be inefficient or otherwise disadvantageous.

Accordingly, it would be advantageous to address some or all of the disadvantages and drawbacks of containers for items when being transported.

SUMMARY

Among the various possible implementations of the present disclosure, a container for transporting, storing, or otherwise holding objects, materiel, or other items may be in the form of a portable, deployable container system. Such portable, deployable container system may include a base and a cover removably securable relative to the base. The cover and base include mating peripheral portions releasably securable relative to each other and defining a container perimeter. The container system also includes a set of panels which may be secured to or separable from both the base and the cover. The panels are sized relative to the base and cover so that they may be selectively placed within the container perimeter and enclosed by the base and the cover, thereby assuming a first container configuration. Such first container configuration may be considered undeployed, in that components to form the container (in this case, some or all of the panels) are stowed or otherwise enclosed within the base and cover.

The panels of the container system may be removed from their enclosed location, and then positioned and releasably or removably secured relative to each other and relative to peripheral portions of the base and cover, so as to define a second container configuration enclosing a second volume greater than that of the first container configuration. When the panels have been removably secured relative to the base, cover and each other, they may be considered to form a deployed container configuration, surrounding one or more objects received in the second volume.

The above described structural components (including base, cover, and panels) are selectively connected to each other by one or more duckbill connections which are adapted and located to connect mating peripheral portions of the base and the cover when in the first, undeployed container configuration, and to connect at least some of the panels to corresponding peripheral portions of the base and the cover when in the second, deployed container configuration. In one suitable implementation, each of the duckbill connections comprises two, spaced, outwardly flared walls and a receiving channel therebetween, as well as a flange adapted to be removably received in the receiving channel. The duckbill connections are formed by having the flared walls on one of the structural elements and the flange to be received within the flared walls on another of the structural elements to be connected to the first structural element.

In certain implementations, the container has a quadrilateral perimeter with duckbill connections extending over a majority of the perimeter or substantially all of the perimeter.

While the number and configuration of panels to be secured to base and/or cover of the container may be varied, one arrangement has two panels removably securable to each of two peripheral walls of the base, and one panel removably securable to the other two peripheral walls, in the case of a quadrilateral. So, for example, in the case of a rectangular box container, six of the panels may be provided, two on each of the longitudinal sides and one on each of the ends. In such configuration, the side panels include shoulders at their outer ends which can be brought against edge portions of the end panels to engage such end panels and strengthen the container at such locations.

Similarly, the cover of the container may include edge portions which extend over the end panels to captivate, capture, or otherwise engage such end panels at their upper edges, again, further supporting the structural integrity of the resulting container when in its second, deployed configuration.

The duckbill connections, according to certain implementations, may have their walls flaring outwardly at their upper ends by about 15° relative the orientation of the lower ends of such walls. The channels formed between the flared walls are larger relative to the flanges received therein, so that the flanges and the structural elements associated with such flanges may be slid within the channels into which they have been received. Such sliding engagement permits the side panels to be removed relative to each other so that their shoulders can be brought into engagement with other panels, such as the end panels described previously.

In certain implementations, the cover may be formed of two or more pieces, which pieces may be slid relative to each other when removably received in duckbill connections and such sliding of the cover portions may aid in bringing the cover edges into engagement with the end panels as described previously.

BRIEF DESCRIPTION OF THE DRAWINGS

The disclosure will be better understood by reference to other drawings, in which.

DETAILED DESCRIPTION

Figure 1:
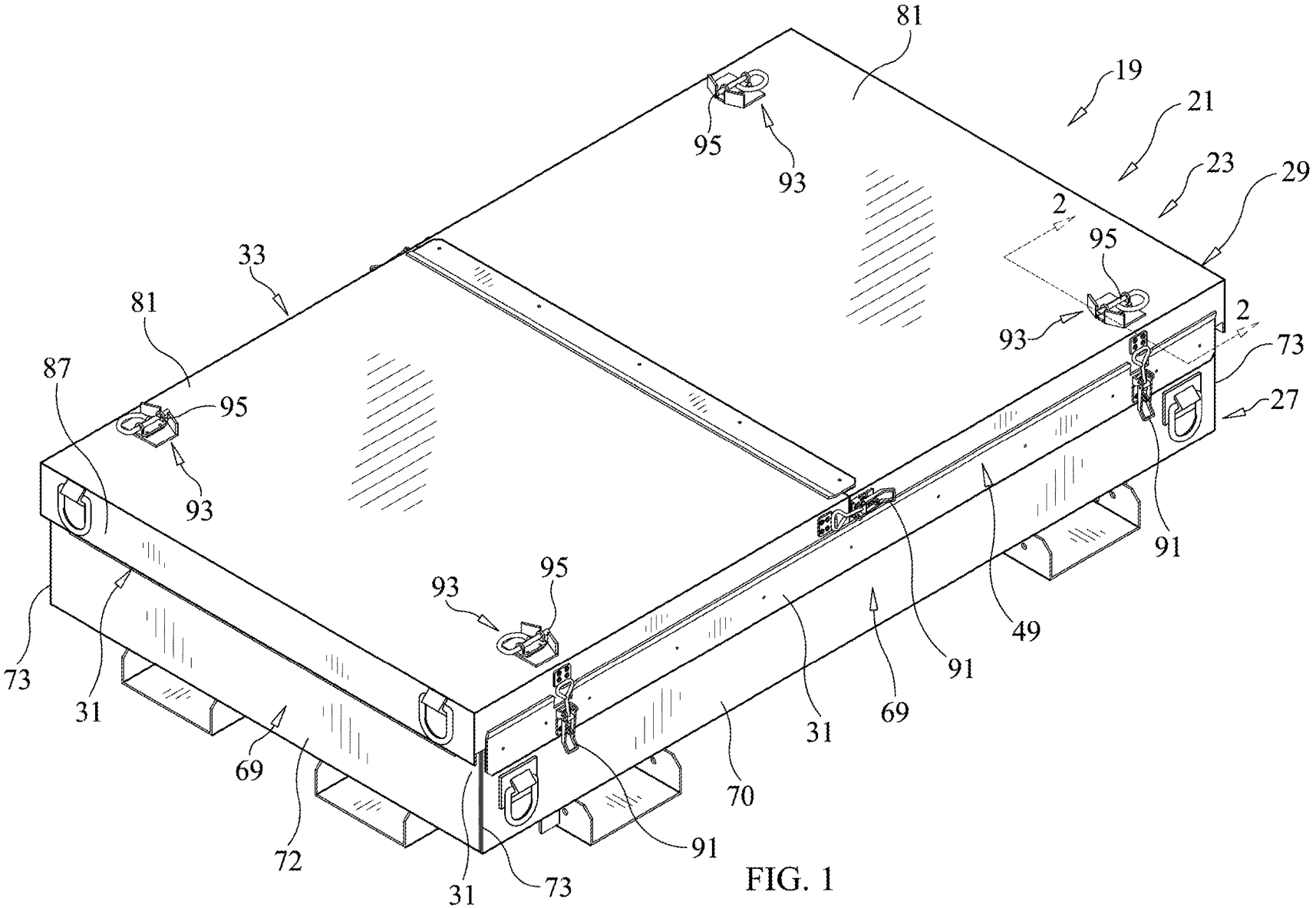
FIG. 1 is a perspective view, according to one implementation of this disclosure, of a portable, deployable container system in a first configuration.
Figure 5:
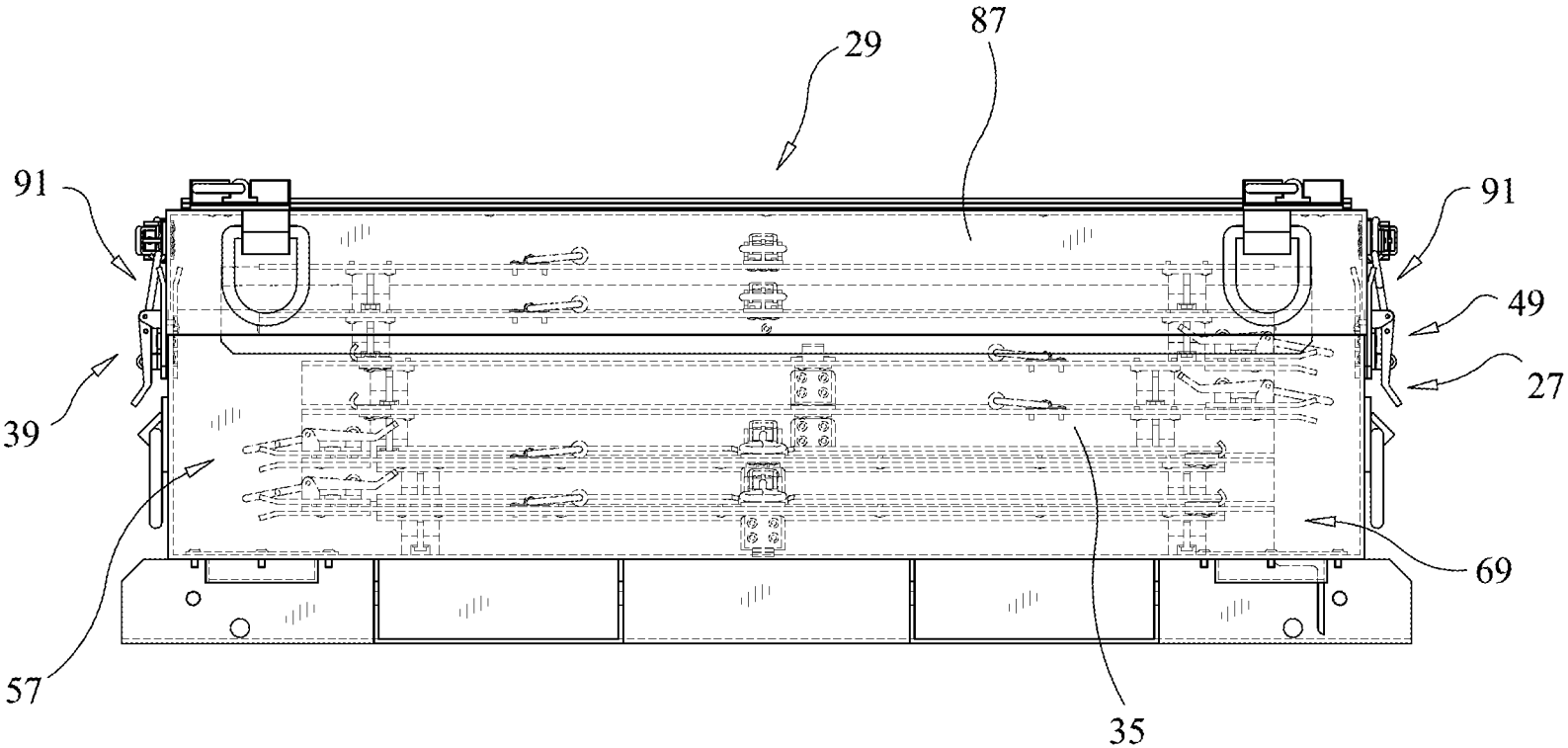
FIG. 5 is an end, elevational view of the implementation shown in FIGS. 1-4.
Figure 6:
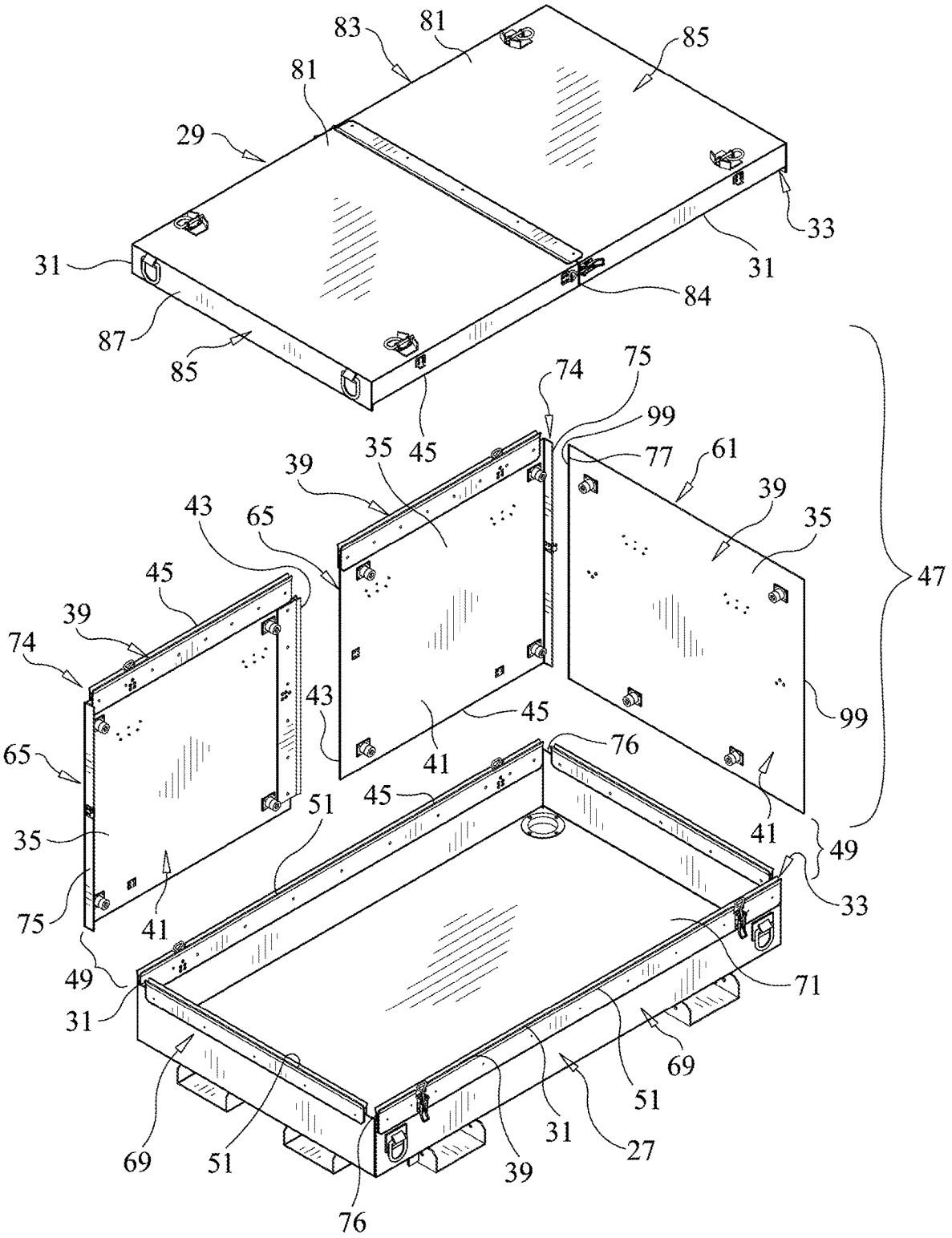
FIG. 6 is an exploded perspective view of certain of the structural elements of the implementation illustrated in FIGS. 1-5.
Figure 7:
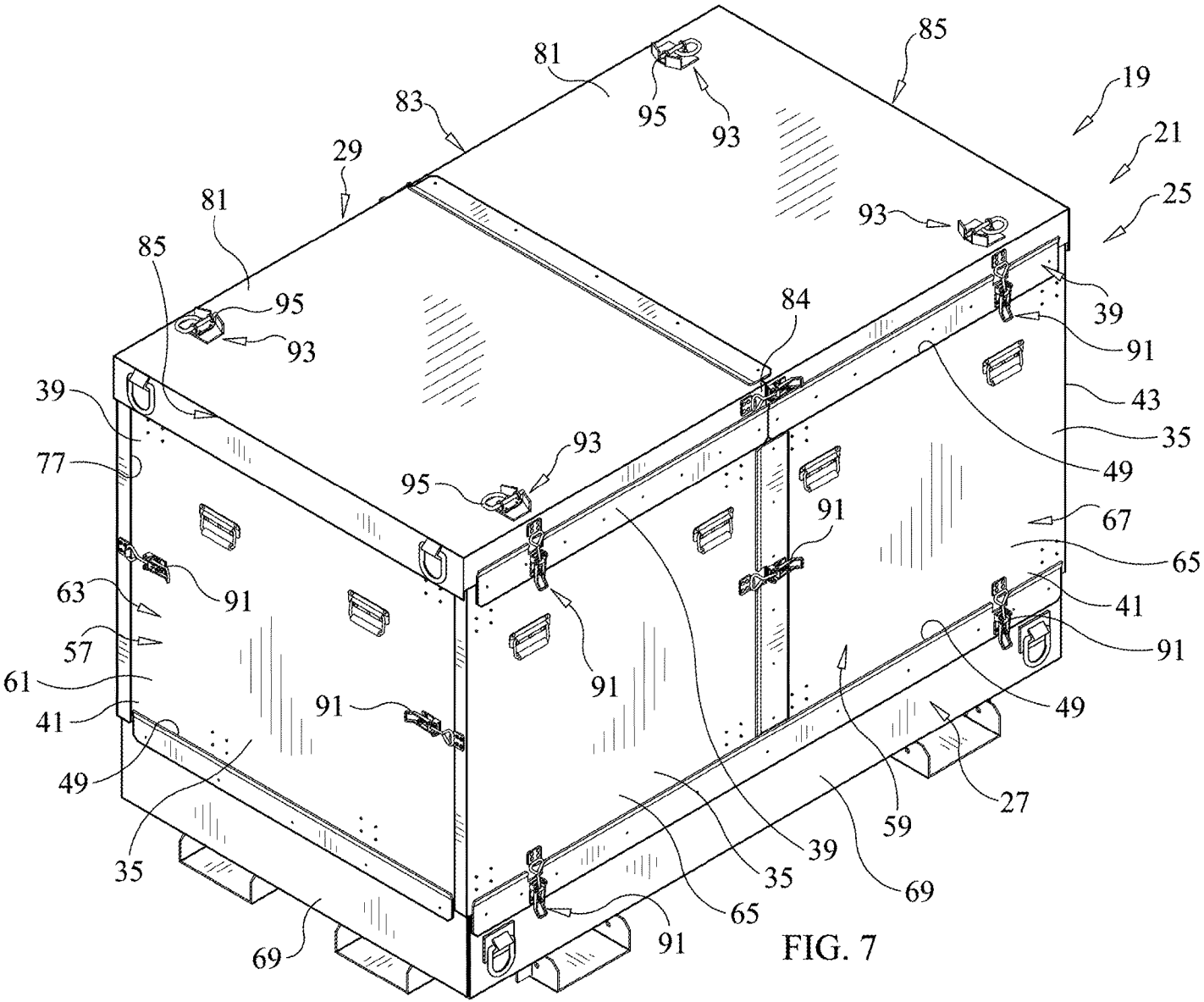
FIG. 7 is a perspective view of the implementation shown in FIGS. 1-6, with structural elements removably secured and latched to each other to form a second container configuration.

Referring now to the drawings, including FIGS. 1-7, a rigid container 19 for shipping or otherwise transporting objects to be enclosed and protected therein may be designed to be in the form of a container system 21. Container system 21 may have features so that it is portable, as required for shipping or other transport of the object or objects enclosed therein. Container system 21 is further provided with features as explained herein so that it can be deployable between two configurations: a first, undeployed container configuration 23, one implementation of which is shown in FIG. 1; and a second, deployed container configuration 25, one implementation of which is shown in FIG. 7.

As described herein, then, according to one possible implementation, container system 21 may be in the form of a portable, deployable container system having a plurality of structural elements which are separable from each other as well as being removably securable to each other, so as to form the required configurations of container system 21, such as the undeployed and deployed configurations 23, 25 mentioned above. Accordingly, in this disclosure, for container system 21 and its resultant container 19 formed thereby, when various structural elements are described as removably or releasably securable to each other, such terms are interchangeable and include any manner of connection or interconnection which can be done or undone without destruction or compromise of the structural elements.

Among its structural elements, portable deployable container system 21 includes a base 27 and a cover 29 which is releasably securable relative to base 27. In this implementation, cover 29 is not only removable from its secured relationship relative to the base, but such removal may be in the form of having cover 29 completely separable from base 27 as shown in FIG. 6. Base 27 and cover 29 have mating peripheral portions 31 which are able to be secured relative to each other and thereby define a container perimeter 33. Peripheral portions 31 of base 27 and cover 29 are configured so as to define a first volume 37 (FIG. 3) when base 27 and cover 29 are directly secured to each other.

The structural elements of container system 21 further include a set of panels 35. Panels 35, in the illustrated implementation, are separable from both base 27 and cover 29, as shown, and have respective lengths, widths, thicknesses, and other dimensions selected so that, when panels 35 are separated from base 27 and cover 29, panels 35 may be selectively placed within container perimeter 33. First volume 37 and the sizes of panels 35 have been selected so that all members of the set of panels 35 are enclosed by base 27 and cover 29 within first volume 37. In this way, undeployed container configuration 23 shown in FIG. 1 may form a single, independent, self-contained unit, self-contained in that all of the structural elements to create a container 19 in deployed form (FIG. 7) are contained within first volume 37 of undeployed container configuration 23. Cover 29 is securable relative to base 27 and therefore transportable as part of the self-contained unit, whether to a site for deployment or to be returned for subsequent use in future transportation situations, or for any number of other applications where the compact nature of the undeployed configuration and its self-contained qualities are suitable and useful for materiel and objects associated with container system 21.

Referring now to deployed container configuration 25, in particular FIGS. 6 and 7, the set of panels 35 may be deployed from their stacked relationship within first volume 37 of undeployed configuration 23 (FIG. 3), and arranged in predetermined fashions to occupy corresponding segments or portions of container perimeter 33 (FIGS. 6 and 7). When assuming the deployed container configuration 25, panels 35 are oriented so as to have upper and lower ends 39, 41 respectively and side ends 43. During manipulation of the structural elements into the deployed container configuration 25, therefore, upper and lower ends 39, 41 of panels 35 oppose corresponding peripheral portions of either the base 27 or cover 29, thereby forming opposing ends 45.

As seen in FIGS. 6 and 7, opposing ends 45 are releasably or removably securable relative to each other to define the deployed container configuration 25. By virtue of the set of panels 35 being releasably secured at locations between base 27 and cover 29 around container perimeter 33, a second volume 47 is enclosed in deployed container configuration 25, which second volume 47 is greater than first volume 37. In certain applications, second volume 47 has been predetermined or preselected to enclose one or more fragile or high-value objects therein for transport as cargo by any suitable transport method, whether by aircraft, train, ground vehicle, sea vessel, and the like, or by any combination of the foregoing transportation means. In one potential application, the objects are military materiel and the transport is between, to, or from military locations or related contractor installations or locations.

The releasable or removable securing of structural elements relative to each other includes the use of a plurality of duckbill connections 49. Certain of the duckbill connections are adapted and located to connect mating peripheral portions 31 of base 27 and cover 29 to each other when in the undeployed container configuration 23 (FIG. 1). Other duckbill connections 49 are adapted and located so as to connect at least some of the set of panels 35 to corresponding peripheral portions 31 of the base 27 and cover 29 when in the deployed container configuration (FIGS. 6, 7).

The cross-sectional profile and other physical characteristics of most or all of the plurality of duckbill connections 49 may be substantially similar, so that structural elements may be more readily interchangeable either in the illustrated configuration or in alternative configurations which may have fewer or greater numbers of panels 35. So, for example, as discussed below, components of duckbill connections 49 located to secure mating peripheral portions 31 of base 27 and cover 29 to each other are also configured to form duckbill connections 49 to releasably secure panels 35 to base 27 and cover 29 when in deployed configuration 25.

Figure 2:
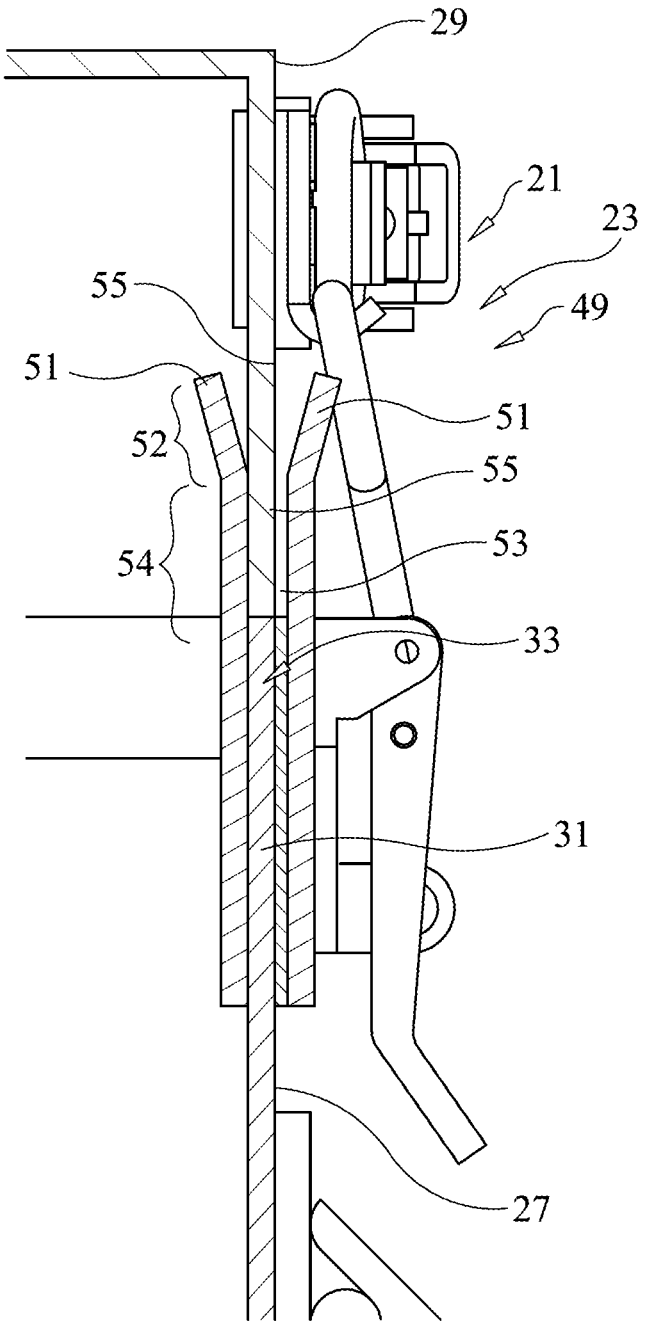
FIG. 2 is an enlarged, cross-sectional view taken along line 2-2 of FIG. 1 and showing an exemplary duckbill connection according to the present disclosure.

Referring now more particularly to FIG. 2, each of duckbill connections 49 comprises two spaced, outwardly flared walls 51 extending parallel to each other over a pre-selected distance to define a receiving channel 53 therebetween, and a flange 55 received in channel 53. Flared walls 51 and receiving channel 53 are located on a first structural element, and flange 55 is located on a second structural element to be releasably secured to the first structural element. Flange 55 is dimensioned or otherwise adapted relative to channel 53 so that flange 55 is removably receivable in channel 53.

When container system 21 is in undeployed configuration 23, duckbill connections 49 are disposed between base 27 and cover 29 so that flared walls 51 extend upwardly from base 27 at peripheral portions 31 of base 27, and flanges 55 extend downwardly from cover 29. When container system 21 is in deployed configuration 25 (FIGS. 6, 7), certain of the panels 35 have flared walls 51 extending from upper ends 39 and flanges 55 extending from lower ends 41, so as to form duckbill connections 49 with flanges 55 on cover 29 and with flared walls 51 on base 27, respectively. Other duckbill connection configurations are likewise possible, including having flared walls 51 and flanges 55 located on the opposite structural elements from those described above. Certain of the duckbill connections 49 extend between opposing ends 45 of base 27 and panels 35, around at least a majority of the length of container perimeter 33 and, in the illustrated implementation, around substantially all of container perimeter 33.

Flared walls 51 facilitate assembly, disassembly, and other relative movements of structural elements of container system 21, such as opposing portions of panels 35, cover 29, and base 27. In one possible implementation, flared walls 51 extend through an arc or an angle at their upper ends of between 10° and 20° relative to respective planes of the lower ends of walls 51, preferably by about 15° outwardly from such planes, having respective radii of curvature of 0.63 inches, and forming a mouth at the upper end defining a total arc or angle of about 30°. Channel 53 has a channel depth of between 1.70 and 1.75 inches, preferably about 1.724 inches, with the upper and/or mouth of the channel having a width of between 0.730 and 0.770 inches, preferably about 0.730 inches, and a lower width of between 0.260 and 0.300 inches, preferably about 0.280 inches. The total depth of channel 53 is between 1.704 and 1.744 inches, preferably about 1.724 inches, defining a flared portion 52 extending by a depth of about 0.750 into channel 53, and further defining an unflared portion 54 extending below the flared portion 52 by about 0.974 to the bottom surface of channel 53, which bottom surface has a width of about 0.280 inches. The duckbill connections may extend around substantially all of the length and width of container 19.

Flange 55 received in channel 53 may have a corresponding thickness of about 3/16" or 0.1875". In one implementation, receiving channel 53 has a width of about 0.289 inches, so that flange 55 is received in receiving channel 53 with a space of about 3/32", that is, a space of about 0.09375". A spacer of 3/32" may be employed between the two walls 51 when such walls are secured to a 3/16"-thick structural element to define the channel width of 0.280" into which 3/16"-thick flanges 55 are slidably received. Although other dimensions and configurations of flanges 55 and channels 53 are suitable and are contemplated by this disclosure, the above-specified ranges and dimensions have been found suitable so that structural elements of deployed configuration 25 remain in substantially fixed position with appropriate rigidity and strength characteristics for anticipated loads when secured or interconnected, yet certain structural elements are relatively and selectively separable or slidable relative to each other when undeployed are being disassembled.

Container perimeter 33, in the embodiment shown, is quadrilateral and, more particularly, rectangular, that is, with four right angles. As such, whether in the undeployed configuration 23 or the deployed configuration 25, container system 21 is in the form of a rectangular box, and container system 21 thereby comprises a pair of opposite ends 57 and two sides 59 extending longitudinally between opposite ends 57.

Panels 35 have substantially planar inner and outer surfaces. In the illustrated rectangular configuration, panels 35 include a pair of end panel walls 61 which are securable relative to base 27 and cover 29 at the opposite ends 57 of container system 21 and thereby form container end walls 63. The set of panels 35 also includes two pairs of side panel walls 65 which are securable to each of the two sides of container system 21 in substantial alignment with each other, and thereby define two container sidewalls 67.

End and side panel walls 61, 65 have flanges 55 formed at their lower ends 41. In this implementation, flanges 55 are integral to and in fact form the lower edge of the planar surfaces of the panel walls 61, 65.

Base 27 is configured to have flared walls 51 and receiving channel 53 located and oriented to receive flanges 55 at lower ends 41 of the end panel and side panel walls 61, 65. More particularly, peripheral portions 31 of base 27 include four peripheral walls 69, including two side peripheral walls 70 and two end peripheral walls 72, extending upwardly from perimeter 33 by a predetermined height from a floor 71 of base 27 within perimeter 33. Peripheral walls 69 in this embodiment comprise part of the container sidewalls and end walls by extending upwardly from floor 71. As such, peripheral walls 69 of base 27 have respective lengths corresponding to the length of the container end walls and sidewalls, each of the peripheral walls 69 of base 27 having two spaced flared walls 51 extending upwardly therefrom and over substantially all of the lengths of peripheral walls 69 of base 27.

In assembling container 19 into the deployed configuration 25, each of the end panel walls 61 is removably securable to the transverse or shorter end peripheral walls 72 of base 27. End panel walls 61 are removably received in flared walls 51 and channel 53 formed on the end peripheral walls 72 at opposite ends of base 27, such end panel walls having flanges 55 at lower ends received in corresponding flared walls 51. Then, one pair of side panel walls 65 are secured to each of the longitudinally extending side peripheral walls 70 of base 27.

Side panel walls 65 include opposing side panel edges 90. When being assembled into deployed configuration 25, side panel edges 90 are securable to each other by a corresponding one of duckbill connections 49. Side panel walls 65 terminate in outer panel edges 74, and include a shoulder 75 at such outer panel edges 74, which shoulder 75 extends orthogonally from planar surfaces of side panel walls 65. Shoulder 75 is located to engage opposing outer surfaces 77 of end panel walls 61, which outer surfaces 77 extend upwardly from base 27 and adjacent to corners 73 of peripheral walls 69 of base 27. Flared walls 51 disposed along the two, end peripheral walls 72 of base 27 do not extend fully to respective corners 73, thereby forming a gap 76 between the end of flared walls 91 and corner 73. The transverse length of gap 76 is sufficient to permit shoulder 75 to be slid past the outer surface of flared walls 51 and thus engage end panel walls 61 received between such flared walls 51.

Cover 29 has cover sides 89 extending longitudinally between transverse cover ends 85. Cover sides 89 have cover side edges 83 and flanges 55 formed thereon extend downwardly from cover side edges 83 to engage either corresponding flared walls 51 located on corresponding panels 35 when in the deployed configuration 25, or corresponding flared walls 51 on base 27 in the undeployed container configuration.

Accordingly, there are two, duckbill connections 49 extending longitudinally along cover side edges 83 to removably secure cover 29 to other structural elements of container system 21. In this way, when in deployed configuration 25, cover 29 encloses second volume 47 and can be selectively secure thereto or removed therefrom, upon which latter case, cover 29 is completely separated from container sidewalls 67 formed by the two pairs of side panel walls 65.

In the illustrated implementation, cover 29 includes two, cover portions 81, with inner and outer planar surfaces extending to container perimeter 33. Cover portions 81 are located relative to each other to form a pair of opposing cover edges 84 which are removably securable to each other by one of the duckbill connections 49 located on cover 29 at opposing edges 84. Cover 29 extends between two transverse ends 85 which terminate in a pair of outer cover edges 87 which extend downwardly and orthogonally from planar surfaces of cover 29. Such outer cover edges 87 are located and configured so as to captivate, capture or otherwise engage end panel walls 61 at upper end portions of such end panel walls 61. In that way, orthogonal cover edges 87, when in the deployed configuration 25, assist in maintaining end panel walls 61 received and retained within container perimeter 33 defined by base 27 and cover 29.

In addition to removably securing structural elements of container system 21 to each other by means of duckbill connections 49, container system 21 includes one or more latches 91 to secure base 27, cover 29, and panels 35 relative to each other when such structural elements are removably received and secured by duckbill connections 49. For example, a plurality of latches 91 may be secured at or operatively adjacent to mating peripheral portions 31 between base 27 and cover 29. In one implementation, latches 91 have a female or latching portion extending from upper end of peripheral walls 69 of base 27 to engage corresponding flanges or male portions located appropriately on longitudinal cover sides 83 of cover 29. Similarly, lower ends 41 of panels 35 may be provided with flanges or male components to be secured by female or latch components of base 27. Upper ends 39 of panels 35, similar to base 27, may be provided with female or latch components which, in turn, engage the same male components or flanges on cover 29 when in the deployed container configuration 25 (FIG. 7) as are engaged by the latches on base 27 when in the undeployed configuration (FIG. 1). Latches 91 add securing force to maintain flanges 55 engaged within receiving channels 53 between flared walls 51 of duckbill connections 49. Otherwise stated, latches 91 resist tensile forces, that is, forces which the container system 21 may experience to separate base 27, cover 29, and panels 35 from their respective securement by duckbill connections 49.

Figure 4:
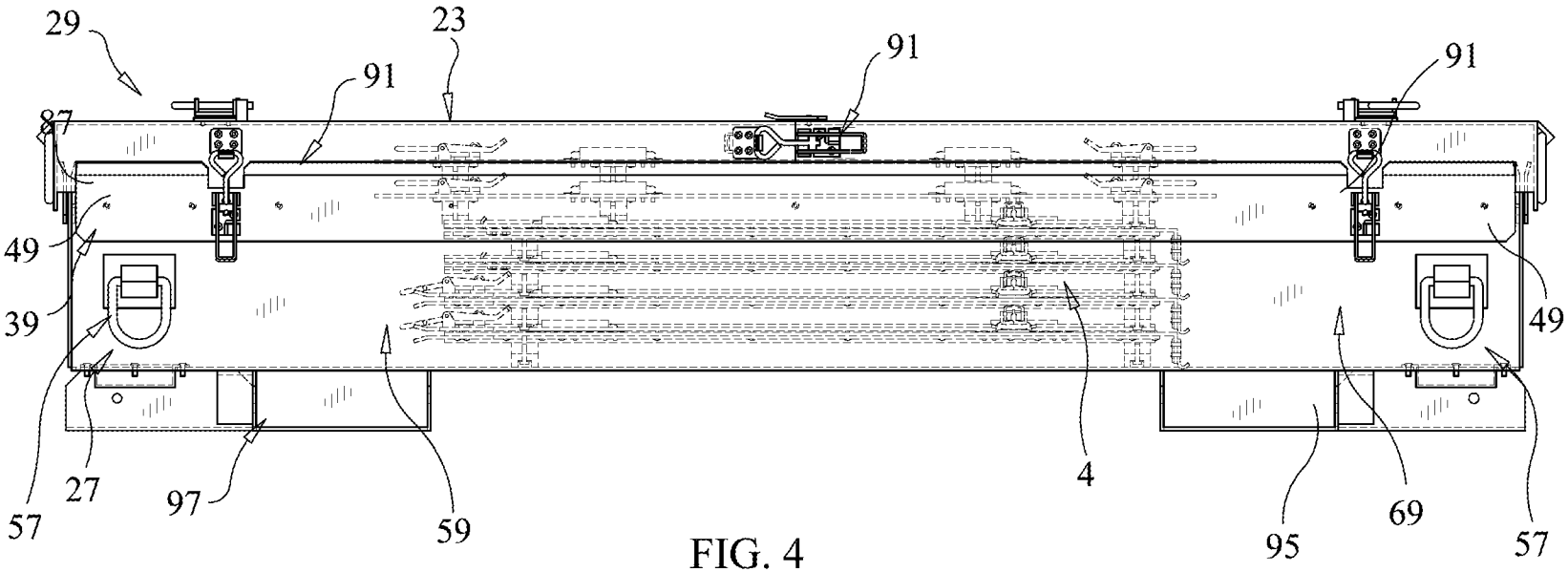
FIG. 4 is a side elevational view of the implementation of FIGS. 1-3.

Container system 21 is suitable for use with a plurality of such container systems and thereby includes one or more stacking latches 93 to permit container system 21 in the illustrated embodiment to be connected to another one of such systems or to any other container having complimentary mating portions with stacking latches 93. In this implementation, four of the stacking latches 93 are at spaced locations along cover 29 and include slidable pins to be received in slots 97 formed on the lower surface of base 27 of another container 19 or container system 21. (FIGS. 4, 5). An arrangement of connecting cover 29 of one container system to the base 27 of another container system means that stacking latches 93 are able to secure multiple ones of the container systems 21, whether such systems are in the deployed configurations 25 or undeployed configuration 23.

Figure 3:
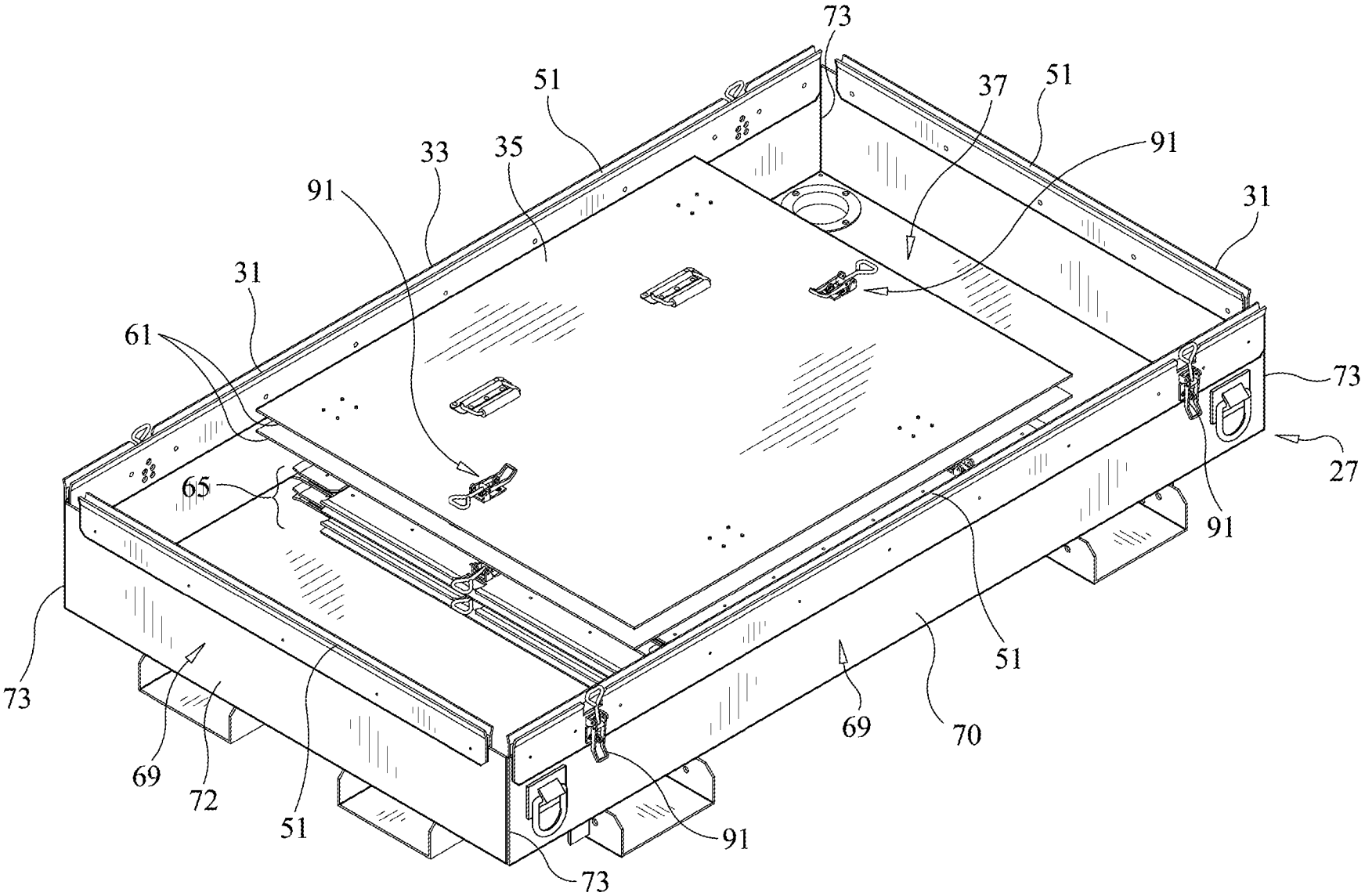
FIG. 3 is a perspective view of the implementation shown in FIGS. 1 and 2 with cover removed to show a set of panels enclosed within the perimeter of the container system.

The assembly or reconfiguration of container system 21 into its deployed configuration 25 by appropriate interconnection of panels 35, base 25, and cover 27 is apparent from the foregoing description. Starting from container system 21 in undeployed container configuration 23 (FIG. 1). The components for creating container 19 may be entirely enclosed within first volume 37 (FIGS. 3-5). Cover 29 is unlatched from its securement relative to base 27. If desired, cover portions 81, which are secured to each other by a pair of the latches 91 on longitudinal sides thereof, may be unlatched from each other and opposing transverse edges 85 of cover portions 81 may be separated from the corresponding duckbill connection 49. In those cases where the set of panels 35 has been enclosed within first volume 37, separation of cover 29 from the other structural elements of container system 21 reveals the set of panels 35 necessary to deploy system 21 and form container 19.

The set of panels 35 is then removed from first volume 37 and manipulated for subsequent assembly in order to construct container side walls 67 and container end walls 63. Although there may be variation in the order of assembly steps, in one possible assembly scenario, end panel walls 61 are positioned at corresponding end walls of peripheral walls 69 of base 27. Lower ends 41 of end panel walls 61 comprise a suitably sized and oriented one of flanges 55, in this case corresponding to its lower edge, and this lower edge and corresponding flange 55 are removably inserted between flared walls 51 at each of the end peripheral walls 72 thereby forming two of the duckbill connections 49.

In view of the relative dimensions of flanges 55 to channels 53, duckbill connections 49 are configured so that flared walls 51 assist in guiding opposing flange 55 into receiving channel 53 until it is seated at the bottom of said channel. Furthermore, panels 35 in general, and end panel walls 61 in particular, are slidable relative channel 53 into which they are removably received. In this case, end panel walls 61 may be slid transversely within the receiving channels 53 extending transversely at peripheral walls 72 of base 27, if necessary, to align them to container perimeter 33, that is until side edges 99 of end panel wall 61 are in substantial alignment with the longitudinal extending side peripheral walls 70 of base 27.

The container side walls 67 may then be assembled by suitable manipulation of each of the pairs of side panel walls 65 relative to base 27 and end panel walls 61 previously secured to base 27. So, for example, in one possible assembly procedure, each of panel walls 65 is brought in opposition to the side peripheral walls 70 of base 27 so that flanges 55 on lower ends 41 are received in opposing receiving channels 53, thereby forming duckbill connections 49. The side panel walls 65 are located longitudinally relative to opposing corners 73 so that shoulders 75 on each of side panel walls 65 are to the outside of end panel walls 61. Given the ability to slide flanges 55 of side panel walls 65 relative to corresponding receiving channels 53, for each of the longitudinal sides of base 27, side panel walls 65 may be slid toward one another. Side panel walls 65 have been configured so that engagement of shoulders 75 with end panel walls 61 occurs when opposing side ends 43 of side panel walls 65 form a corresponding duckbill connection between 49 the opposing side panel edges 90 at side ends 43.

Having positioned all members of the set of panels 35 previously enclosed first in volume 37 around container perimeter 33, container end walls 63 and side walls 67 have been assembled and surround second volume 47. To fully enclose such volume, cover 29 is brought into position, either as a unit with both cover portions 81 secured to each other in advance, or as two separate cover portions 81. In the case of cover 29 being manipulated as a single structural component, it is brought into position so that cover sides 83 with downwardly extending flanges 55 located thereon oppose upper ends 39 of side panels 65 from which flared walls 51 extend. Cover 29 is dimensioned so that outer cover edges 87 captivate or engage upper ends of end panel walls 61 when duckbill connections 49 are formed between cover sides 83 and side panel walls 65.

Another possible assembly of cover 29 to the other components of container system 21 involves having cover 29 in the form of two separate cover portions 81. Each of the cover portions 81 may be placed such that their flanges 55 are received in corresponding flared walls 51 to form corresponding duckbill connections 49. Each of the cover portions may be slid inwardly toward each other, in which case flanges 55 are being translated inwardly within receiving channels 53 of side panel walls 65. Similar to the configuration of side panels 65 engaging side peripheral walls 20 of base 27 discussed previously, cover portions 81 may be slid inwardly sufficiently to have their outer cover edges 87 engage opposing upper ends of end panel walls 61, at which point transverse inner ends 85 of cover portions 81 are brought into opposing relationship and are removably secured to each other by a duckbill connection 49 formed at the opposing transverse ends 85. Latches 91 between opposing transverse edges 83 may then be actuated to secure cover portions 81 relative to each other. In general terms, the structural elements described above for container system 21, when assembled into deployed configuration 25, may be further secured relative to each other at any suitable point after assembly by means of latches 91 described previously.

In this implementation, the opposing ends described for panels 35, cover 29 and base 27 have duckbill connections 49 formed at edges thereof but other locations spaced from such edges are likewise considered suitable locations for forming the requisite duckbill connections 49.

One or more objects (not shown) to be transported, stored, or enclosed for any other reason, may be placed within container perimeter 33 at any suitable and desired time during deployment, breakdown, or at other points of configuration or reconfiguration of container system 21. For example, in certain applications, materiel may be loaded onto base 27 after panels 35 have been removed from first volume 37 and before cover 29 is definitively latched onto the upper ends of panels. So, as a further example, if one or more particularly large objects have profiles which substantially fill second volume 47, such objects may be loaded onto floor 71 of base 27 prior to assembly of panels 35 around container perimeter 33. Alternately, objects occupying container 19 when it has second volume 47 may be accessed after panels 35 have been removably secured within duckbill connection 49 and latched to base 27, at any time prior to it being enclosed by cover 29.

Unloading likewise may occur before or after panels 35 have been separated from base 27. In certain applications, unloading may require or may be substantially simplified by removal of one or more of panels 35, so that personnel, hoists, or other equipment may access container contents from a lower height than when panels 35 are erect.

Accordingly, in addition to the advantages apparent from the foregoing description, having panels 35 completely separable from both base 27 and cover 29 permits cargo to be readied for transport without having to hoist such cargo over the height of panels 35.

As another advantage, container system 21 has the flexibility to be assembled from and disassembled into a more compact configuration.

As a still further advantage, duckbill connections 49 provide adequate strength to transport and protect contents within container 19. In one suitable implementation, panels 35 and other planar structural elements are made of lightweight aircraft-grade 6061-T6 aluminum alloy panels having a 3/16" thickness.

The container system 21 may be adapted for various military uses, including transport of instrumentation and other materiel, in which case, for extremely valuable or delicate cargo, most components are made of the aforesaid aluminum alloy. Nonetheless, for applications requiring more or less robust containment, the foregoing principals of a self-contained container system with separable walls may be made with different thicknesses, different metals, or include polymeric or fibrous materials.

While this invention has been described with reference to specific embodiments disclosed herein, it is not confined to the details set forth and the patent is intended to include modifications and changes which may come within the spirit and scope of the invention described herein and in the following claims.

What is claimed is:

1. A portable, deployable container system, comprising:

a base;

a cover removably securable relative to the base, wherein the base and the cover are dimensioned to have mating peripheral portions releasably securable relative to each other and defining a container perimeter;

a set of panels separable from both the base and the cover, wherein the panels have respective lengths, widths, and thicknesses selected so that, when separated from the base and the cover, the set of panels may be selectively placed within the container perimeter and enclosed by the base and the cover to define an undeployed container configuration, the undeployed container configuration enclosing a first volume;

wherein the panels and the peripheral portions are positionable relative to each other to define opposing ends therebetween, wherein the opposing ends are securable relative to each other to define a deployed container configuration enclosing a second volume greater than the first volume;

a plurality of duckbill connections adapted and located to connect the mating peripheral portions of the base and the cover when in the undeployed container configuration and to connect at least some of the panels to corresponding ones of the peripheral portions of the base and the cover when in the deployed container configuration;

wherein each of the duckbill connections comprises two, spaced, outwardly flared walls and a receiving channel therebetween, and a flange adapted to be removably receivable in the channel;

wherein, when the container system is in the undeployed configuration, the flared walls extend from one of the cover and the base and the flange extends from the other of the cover and the base; and wherein, when the container system is in the deployed configuration, the flared walls extend from one of the opposing ends and the flange extends from the other of the opposing ends.

2. The system of claim 1, wherein the plurality of duckbill connections extends over a majority of the perimeter.

3. The system of claim 1, wherein the perimeter is quadrilateral.

4. The system of claim 3, wherein the duckbill connections extend over substantially all of the perimeter.

5. The system of claim 1, wherein the opposing ends comprise opposing edges; and wherein the outwardly flared walls extend from one of the opposing edges.

6. The system of claim 1, wherein the peripheral portions of the base comprise four peripheral walls having respective lengths, each of the peripheral walls having the two, spaced, outwardly flared walls of at least some of the duckbill connections extending upwardly therefrom and over substantially all of the respective lengths of the peripheral walls.

7. The system of claim 6, wherein two of the peripheral walls of the base each have two of the panels removably securable thereto; and wherein an additional two of the peripheral walls each have one of the panels removably securable thereto.

8. The system of claim 7, wherein, the two panels removably securable to each of the two peripheral walls further comprise opposing panel edges secured to each other by one of the plurality of duckbill connections.

9. The system of claim 8, wherein the base consists of four of the peripheral walls.

10. The system of claim 9, wherein the peripheral walls terminate in four, corresponding corners located on the base, and wherein the panels securable to the base include flanges located to engage the corners of the base when in the deployed configuration.

11. The system of claim 1, wherein the cover comprises first and second cover portions, each of the cover portions having four sides terminating in corresponding end portions;

wherein one of the end portions of the first cover portion opposes one of the end portions of the second cover portion to define opposing cover edges;

wherein one of the plurality of duckbill connections is located on the cover between the cover portions to removably secure the first and second cover portions relative to each other at the opposing cover ends thereof; and wherein at least some of the peripheral portions of the cover comprise cover edges extending downwardly when the cover is secured to the panels in the deployed configuration, the cover edges located to engage the panels at upper end portions thereof;

whereby the panels engaged by the cover edges are received and retained within the perimeter defined by the base and the cover.

12. The system of claim 1, wherein the container system comprises a pair of opposite ends and two sides extending longitudinally between the opposite ends;

wherein the set of panels comprises a pair of end panel walls securable relative to the cover and the base to form container end walls located at the container ends; and wherein two of the panels are securable in substantial alignment with each other on each of the sides of the container to define two, container sidewalls.

13. The system of claim 12, wherein the container sidewalls have upper ends removably securable to the cover by at least some of the duckbill connections, the duckbill connections having the two outwardly flared walls extending upwardly from the upper ends of the container sidewalls and the flanges extending downwardly from the cover when the container system is in the deployed container configuration.

14. The system of claim 1, wherein the duckbill connections are configured to have the flange and the channel manually slidable relative to each other when the flange is received in the channel, whereby respective ones of the panels, the base, and the cover may be slidably assembled or disassembled when forming the deployed configuration and the undeployed configuration.

15. The system of claim 1, further comprising one or more latches secured on the base to connect the base to at least one of the following: one or more of the panels and the cover.

16. The system of claim 1, further comprising a stacking latch having mating portions on the cover and the base to permit connection of the container system to another one of the container systems, the latch adapted to secure the container systems in both the deployed configuration and the undeployed configuration.

17. The system of claim 1, wherein the two, outwardly flaring walls of the duckbill connections flare outwardly relative to vertical by about 15 degrees.

18. A portable, deployable container system, comprising:

a base;

a cover removably securable relative to the base, wherein the base and the cover are dimensioned to have mating peripheral portions releasably securable relative to each other and defining a container perimeter;

a set of panels separable from both the base and the cover, wherein the panels have respective lengths, widths, and thicknesses selected so that, when separated from the base and the cover, the set of panels may be selectively placed within the container perimeter and enclosed by the base and the cover to define an undeployed container configuration, the undeployed container configuration enclosing a first volume;

wherein the panels and the peripheral portions are positionable relative to each other to define opposing ends therebetween, wherein the opposing ends are securable relative to each other to define a deployed container configuration enclosing a second volume greater than the first volume;

a plurality of duckbill connections adapted and located to connect the mating peripheral portions of the base and the cover when in the undeployed container configuration and to connect at least some of the panels to corresponding ones of the peripheral portions of the base and the cover when in the deployed container configuration;

wherein each of the duckbill connections comprises two, spaced, outwardly flared walls and a receiving channel therebetween, and a flange adapted to be removably receivable in the channel;

wherein, when the container system is in the undeployed configuration, the flared walls extend from one of the cover and the base and the flange extends from the other of the cover and the base;

wherein, when the container system is in the deployed configuration, the flared walls extend from one of the opposing ends and the flange extends from the other of the opposing ends;

wherein the container system comprises a pair of opposite ends and two sides extending longitudinally between the opposite ends;

wherein the set of panels comprises a pair of end panel walls securable relative to the cover and the base to form container end walls located at the container ends; and wherein two of the panels are securable in substantial alignment with each other on each of the sides of the container to define two, container sidewalls;

wherein the container sidewalls have upper ends removably securable to the cover by at least some of the duckbill connections, the duckbill connections having the two outwardly flared walls extending upwardly from the upper ends of the container sidewalls and the flanges extending downwardly from the cover when the container system is in the deployed container configuration; and wherein the duckbill connections are configured to have the flange and the channel manually slidable relative to each other when the flange is received in the channel, whereby respective ones of the panels, the base, and the cover may be slidably assembled or disassembled when forming the deployed configuration and the undeployed configuration.

* * * * *